US010690142B2

(12) United States Patent
Uda

(10) Patent No.: US 10,690,142 B2
(45) Date of Patent: Jun. 23, 2020

(54) BLADE OF CROSS-FLOW FAN

(71) Applicant: DAIKIN INDUSTRIES, LTD., Osaka-shi, Osaka (JP)

(72) Inventor: Masafumi Uda, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 581 days.

(21) Appl. No.: 15/107,434

(22) PCT Filed: Dec. 18, 2014

(86) PCT No.: PCT/JP2014/083543
§ 371 (c)(1),
(2) Date: Jun. 22, 2016

(87) PCT Pub. No.: WO2015/098689
PCT Pub. Date: Jul. 2, 2015

(65) Prior Publication Data

US 2017/0002827 A1 Jan. 5, 2017

(30) Foreign Application Priority Data

Dec. 27, 2013 (JP) ..... 2013-272151

(51) Int. Cl.
*F04D 29/28* (2006.01)
*F24F 1/0025* (2019.01)
(Continued)

(52) U.S. Cl.
CPC ..... *F04D 29/283* (2013.01); *F04D 17/04* (2013.01); *F04D 29/30* (2013.01); *F04D 29/661* (2013.01); *F24F 1/0025* (2013.01)

(58) Field of Classification Search
CPC .... F04D 29/242; F04D 29/245; F04D 29/281; F04D 29/282; F04D 29/283; F04D 17/04;
(Continued)

(56) References Cited

U.S. PATENT DOCUMENTS 3,952,971 A * 4/1976 Whitcomb ..... B64C 3/14 244/35 R
6,565,334 B1 * 5/2003 Bradbury ..... F04D 29/384 361/695
(Continued)

FOREIGN PATENT DOCUMENTS

JP 5-79492 A 3/1993
JP 3661579 B2 4/2005
(Continued)

OTHER PUBLICATIONS

International Search Report of corresponding PCT Application No. PCT/JP2014/083543 dated Mar. 24, 2015.
(Continued)

*Primary Examiner* — Kenneth J Hansen
*Assistant Examiner* — Justin A Pruitt
(74) *Attorney, Agent, or Firm* — Global IP Counselors, LLP

(57) ABSTRACT

A blade of a cross-flow fan including leading and trailing edge portions arranged on inner and outer peripheral sides of the cross-flow, and a base portion formed between the edge portions. The edge portions are arc shaped. The base portion has a pressure surface and a suction surface. A radius of the leading-edge portion is greater than a radius of the trailing-edge portion. A maximum thickness is at a position of maximum thickness that is closer to the leading-edge portion than to the trailing-edge portion. A first thickness is at midpoint of a blade chord. A second thickness is at a position set apart from an outer-peripheral end of the blade chord by 5% of the chord length. A value obtained by dividing the first thickness by the maximum thickness that is greater than a value obtained by dividing the second thickness by the first thickness.

2 Claims, 9 Drawing Sheets

(51) Int. Cl.
*F04D 29/66* (2006.01)
*F04D 17/04* (2006.01)
*F04D 29/30* (2006.01)

(58) Field of Classification Search
CPC ..... F04D 29/30; F04D 29/544; F04D 29/66; F04D 29/661; F04D 29/666; F04D 29/384; F24F 1/0025
USPC ..... 416/178
See application file for complete search history.

(56) References Cited

U.S. PATENT DOCUMENTS

| | | | | |
|---|---|---|---|---|
| 7,422,418 | B2 * | 9/2008 | Ishijima | F04D 29/283 415/119 |
| 2009/0263252 | A1 * | 10/2009 | Slot | F03D 1/0641 416/223 R |
| 2009/0311101 | A1 * | 12/2009 | Moreau | F04D 29/384 416/179 |

FOREIGN PATENT DOCUMENTS

| | | | |
|---|---|---|---|
| JP | 2009-36138 | A | 2/2009 |
| JP | 5143317 | B1 | 11/2012 |

OTHER PUBLICATIONS

International Preliminary Report of corresponding PCT Application No. PCT/JP2014/083543 dated Jun. 28, 2016.
European Search Report of corresponding EP Application No. 14 87 5882.4 dated Dec. 9, 2016.

* cited by examiner

BLADE OF CROSS-FLOW FAN

CROSS-REFERENCE TO RELATED APPLICATIONS

This U.S. National stage application claims priority under 35 U.S.C. § 119(a) to Japanese Patent Application No. 2013-272151, filed in Japan on Dec. 27, 2013, the entire contents of which are hereby incorporated herein by reference.

TECHNICAL FIELD

The present invention relates to a blade of a cross-flow fan.

BACKGROUND ART

In indoor units of air conditioners, etc., cross-flow fans are often used in order to blow air. As pertains to a cross-sectional shape of a blade of such a cross-flow fan, an pressure surface of the blade and a suction surface opposite the pressure surface are curved along a direction of rotation of the fan further toward the outer side of the blade from a fan rotary shaft, and, near the center of the blade, are formed in an arc shape set apart from a straight line connecting an inner-peripheral part and an outer-peripheral part of the blade.

Conventionally, it is known that in blades in which the thickness distribution in the shape of the blade is configured such that a position of maximum thickness is located between a leading edge and a trailing edge, separation of flow at the leading-edge portion occurs, and turbulence readily occurs. In order to improve such an unstable flow when a high load is applied to the cross-flow fan, the blade structure disclosed in Japanese Patent No. 3661579 is configured such that the position of maximum thickness in the blade is at a location 4% of a chord length of blade from an inner-peripheral end, and the thickness decreases from the position of maximum thickness of the blade toward both end parts. However, in the blade structure disclosed in Japanese Patent No. 3661579, because the position of maximum thickness is at a location 4% of the chord length from an inner side, this position approximately coincides with the inner-peripheral end, and the thickness rapidly decreases toward an outer-peripheral end. Therefore, in some instances, after colliding at the inner-peripheral end, the flow quickly separates off due to the large curvature of the blade surface, and moves downstream in the separated state without rejoining at the outer-peripheral side of the fan on the near side relative to a blade-midpoint position.

In the blade structure disclosed in Japanese Laid-open Patent Application No. 5-79492, the thickness of the blade decreases further toward the outer-peripheral side of a fan so that the distance between blades in a direction perpendicular to a direction of airflow between the blades is substantially the same on the outer-peripheral side and inner-peripheral side of the fan. In the blade disclosed in Japanese Laid-open Patent Application No. 5-79492, when a load is applied, a flow vented out from the fan separates off, at a suction surface side having large curvature, in proportion with direction from an inner-peripheral end of the blade toward an outer-peripheral end of the blade, and readily gives rise to turbulence. Therefore, in the blade disclosed in Patent Document 2, an extremely unpleasant, intermittent abnormal noise referred to as "rustling" is readily generated due to the breakdown of a two-dimensional flow. Additionally, because the flow between the blades in Japanese Laid-open Patent Application No. 5-79492 readily gives rise to turbulence, abnormal noise (low-order narrowband-frequency noise (referred to below as "N noise")) caused by rotation of the fan increases; this noise is projected at low frequencies, inhibiting a noise-reduction property. Furthermore, when a load is applied to the blade disclosed in Japanese Laid-open Patent Application No. 5-79492, blowing performance significantly deteriorates, and therefore cooling capacity and heating capacity of the fan decreases.

SUMMARY

Technical Problem

As described above, in conventional blade structures, separation of flow occurs, reducing the effective inter-blade distance, and the speed of vented-out air increases, correspondingly increasing noise. Additionally, in conventional blade structures, the blade surface cannot be effectively utilized due to the separation of flow, reducing blowing efficiency.

The problem of the present invention is to obtain a blade of a cross-flow fan with which it is possible to provide a cross-flow fan that is highly efficient and that produces little noise even when high loads are applied.

Solution to Problem

A blade of a cross-flow fan according to a first aspect of the present invention comprises: a leading-edge portion arranged on an inner-peripheral side of the cross-flow fan, the leading-edge portion being formed in an arc-like shape; a trailing-edge portion arranged on an outer-peripheral side of the cross-flow fan, the trailing-edge portion being formed in an arc-like shape; and a base portion formed between the leading-edge portion and the trailing-edge portion, the base portion having a pressure surface configured and arranged to generate positive pressure and a suction surface configured and arranged to generate negative pressure; the leading-edge portion and the trailing-edge portion being formed such that the radius of the leading-edge portion is greater than the radius of the trailing-edge portion; and the base portion being formed so as to have a maximum thickness at a position of maximum thickness that is closer to the leading-edge portion than to the trailing-edge portion, a first thickness at the midpoint on a blade chord, and a second thickness at a position set apart from an outer-peripheral end of the blade chord by 5% of the chord length, and furthermore being formed such that a value obtained by dividing the first thickness by the maximum thickness is greater than a value obtained by dividing the second thickness by the first thickness.

In the blade of a cross-flow fan according to the first aspect, as pertains to a flow near the blade when air is vented, the position of maximum thickness is closer to the inner-peripheral side than to the middle of the blade, whereby separation of flow at a suction surface from the leading-edge portion of the blade to the trailing-edge portion of the blade is minimized, the flow from the leading-edge portion to the trailing-edge portion is accelerated, turbulence is suppressed, and low-frequency narrowband noise such as N noise is reduced. Furthermore, since the blade surface at the suction surface has a small curvature because the thickness is smoothly reduced as far as a location near the middle of the blade, it is possible, even if separation of suction surface-side flow occurs, to quickly rejoin the flow at the suction surface and minimize separation to the middle of the blade. Furthermore, because the thickness rapidly decreases from the middle of the blade to the trailing-edge portion, a large inter-blade flow-channel width is maintained from the middle of the blade to the trailing-edge portion, whereby it is possible efficiently to reduce the speed of air vented out between blades through the assistance of a wide flow-channel.

A blade of a cross-flow fan according to a second aspect of the present invention is the blade of a cross-flow fan according to the first aspect of the present invention, wherein the base portion is configured such that the position of maximum thickness is positioned within a range of 5-45% of the chord length from an inner-peripheral end.

In the blade of a cross-flow fan according to the second aspect, the position of maximum thickness is positioned within a range of 5-45% of the chord length from the inner-peripheral end, whereby a relatively high enhancement of efficiency is realized due to the minimization of separation and the reduction of the speed of air between the blades.

A blade of a cross-flow fan according to a third aspect of the present invention is the blade of a cross-flow fan according to the first or second aspect of the present invention, wherein the base portion is configured such that the value of the ratio between the value obtained by dividing the second thickness by the first thickness and the value obtained by dividing the first thickness by the maximum thickness is set to 0.85 or less.

In the blade of a cross-flow fan according to the third aspect, the value of the ratio between the value obtained by dividing the second thickness by the first thickness and the value obtained by dividing the first thickness by the maximum thickness is set to 0.85 or less, whereby a relatively high enhancement of efficiency is realized due to the minimization of separation and the reduction of the speed of air between the blades.

Advantageous Effects of Invention

In the blade of a cross-flow fan according to the first aspect of the present invention, reductions in noise and increases in efficiency of the cross-flow fan are achieved.

In the blade of a cross-flow fan according to the second aspect of the present invention, improvements for increasing efficiency are facilitated.

In the blade of a cross-flow fan according to the third aspect of the present invention, improvements for increasing efficiency are facilitated.

DESCRIPTION OF EMBODIMENTS (1) Cross-Flow Fan in Indoor Unit

Figure 1:
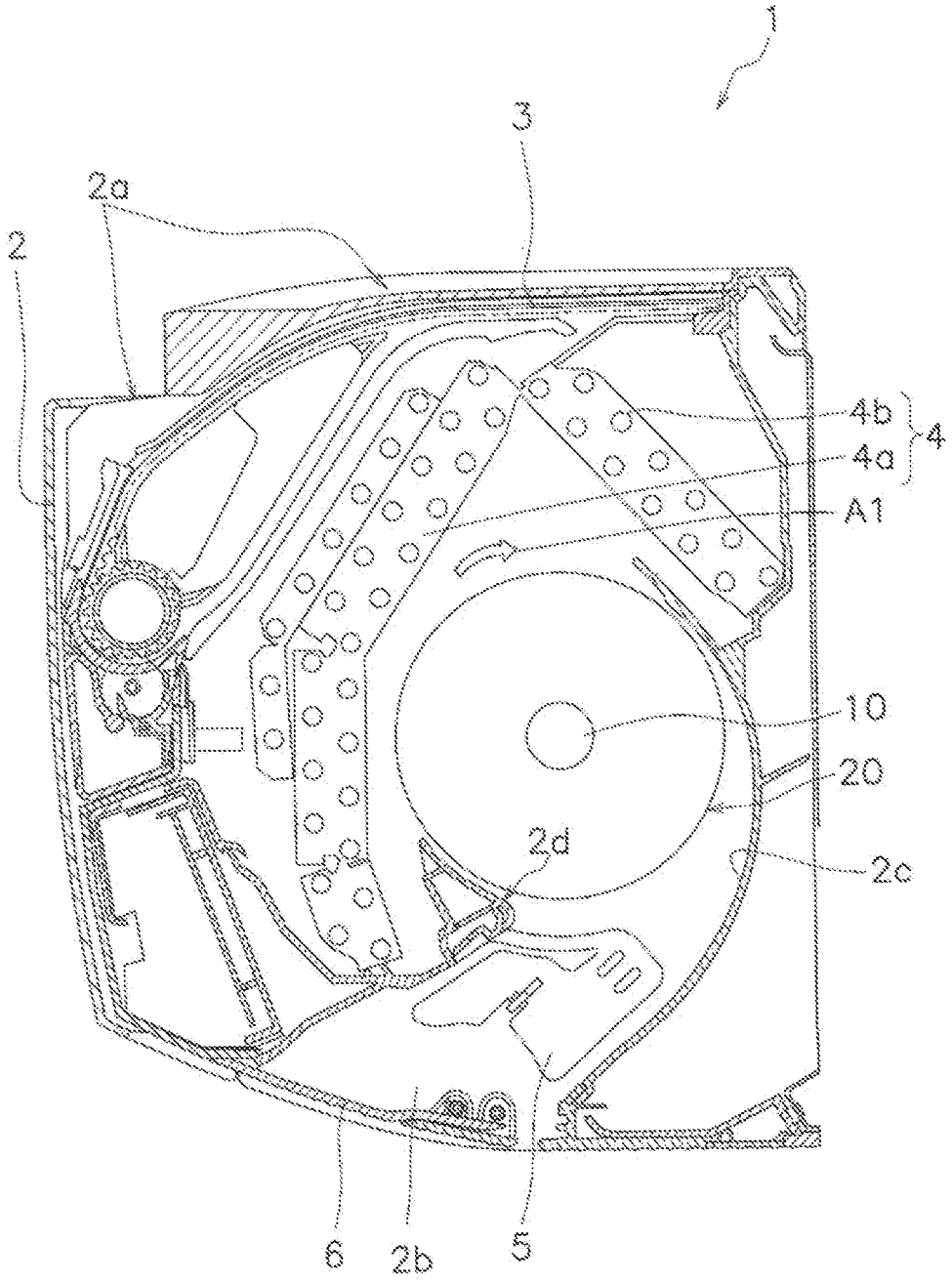
FIG. 1 is a schematic cross-sectional view of an indoor unit of an air-conditioning apparatus.

A multi-blade fan according to a first embodiment of the present invention is described below through the example of a cross-flow fan installed in an indoor unit of an air-conditioning apparatus. FIG. 1 is a schematic view of a cross-section of an indoor unit 1 of an air-conditioning apparatus. The indoor unit 1 comprises a main casing 2, an air filter 3, an indoor heat exchanger 4, a cross-flow fan 10, a vertical flap 5, and a horizontal flap 6.

As shown in FIG. 1, the air filter 3 is arranged downstream from an intake port 2*a* in a ceiling surface of the main casing 2, the air filter 3 facing the intake port 2*a*. The indoor heat exchanger 4 is arranged further downstream from the air filter 3. The indoor heat exchanger 4 is configured by linking a front-surface-side heat exchanger 4*a* and a rear-surface-side heat exchanger 4*b* so as to form an inverse V-shape as viewed from a side surface. The front-surface-side heat exchanger 4*a* and the rear-surface-side heat exchanger 4*b* are configured by attaching a plurality of plate fins to a heat-transfer pipe aligned in parallel with one another in a width direction of the indoor unit 1. All indoor air that passes through the intake port 2*a* and reaches the indoor heat exchanger 4 passes through the air filter 3, and dirt and grit in the indoor air is removed therefrom. The indoor air that has been drawn in through the intake port 2*a* and passed through the air filter 3 is subjected to heat-exchange and air-conditioning when passing between the plate fins of the front-surface-side heat exchanger 4*a* and rear-surface-side heat exchanger 4*b*.

The cross-flow fan 10, which is substantially cylindrical in shape, is provided downstream from the indoor heat exchanger 4, the cross-flow fan 10 extending longitudinally along a width direction of the main casing 2. The cross-flow fan 10 is arranged in parallel with the indoor heat exchanger 4. The cross-flow fan 10 comprises an impeller 20 arranged in a space surrounded so as to be sandwiched in the inverse V-shape of the indoor heat exchanger 4, and a fan motor (not shown) configured and arranged to drive the impeller 20. The cross-flow fan 10 generates an airflow from the indoor heat exchanger 4 toward a vent 2*b* by the rotation of the impeller 20 in a direction A1 shown by arrows in FIG. 1 (i.e., clockwise). Specifically, the cross-flow fan 10 is a transverse fan, configured such that the airflow passes transversely across the cross-flow fan 10.

A rear-surface side of a vent passage linked to the vent 2*b* downstream from the cross-flow fan 10 is configured from a scroll member 2*c*. A lower end of the scroll member 2*c* is linked to a lower edge of an opening of the vent 2*b*. In order to guide indoor air, which is vented out from the cross-flow fan 10, smoothly and silently to the vent 2*b*, a guide surface of the scroll member 2*c* has a smooth curved shape having a center of curvature on the cross-flow-fan 10 side as viewed in cross-section. A tongue part 2*d* is formed on the front-surface side of the cross-flow fan 10, and an upper surface of the vent passage that is continuous from the tongue part 2*d* is linked to an upper edge of the vent 2*b*. A direction in which the airflow is vented out from the vent 2*b* is adjusted using the vertical flap 5 and horizontal flap 6.

(2) Structure of Impeller of Cross-Flow Fan

Figure 2:
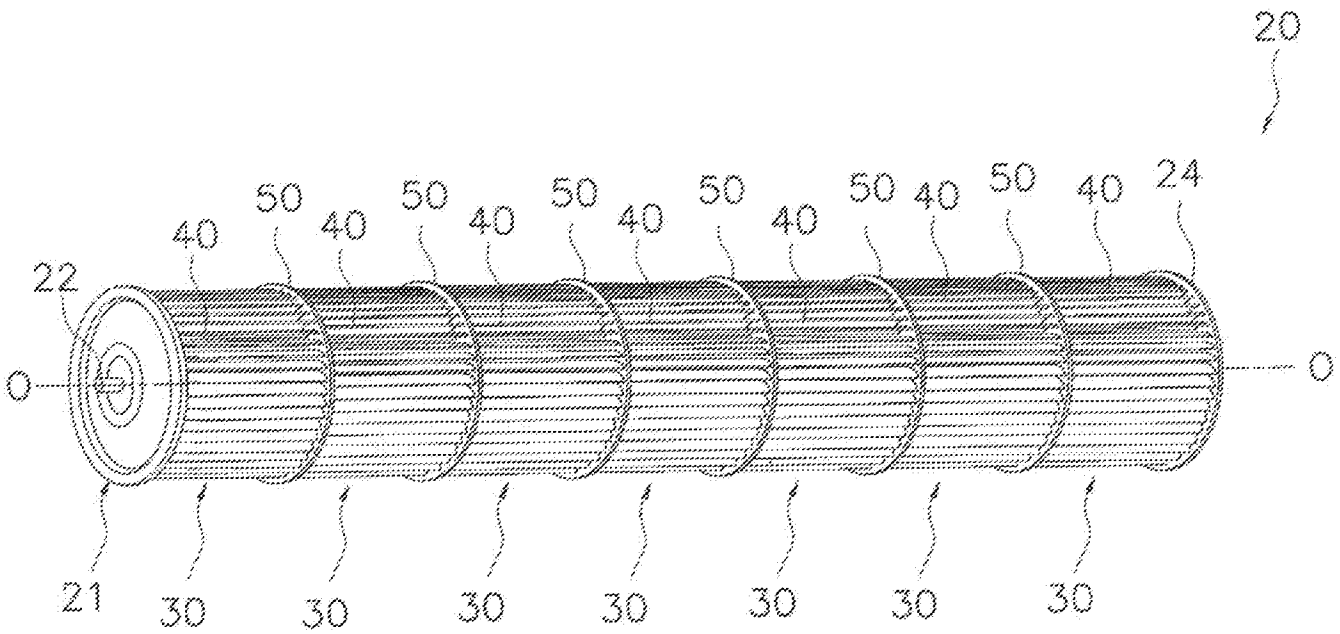
FIG. 2 is a schematic perspective view of an impeller of a cross-flow fan according to an embodiment.

FIG. 2 shows a schematic structure of the impeller 20 of the cross-flow fan 10. The impeller 20 is configured such that, e.g., end plates 21, 24 and a plurality of fan blocks 30 are joined together. In the present embodiment, seven fan blocks 30 are joined together. An end plate 21 is arranged on one end of the impeller 20, and a metal rotary shaft 22 is provided along a central axis O. Each of the fan blocks 30 comprises a plurality of blades 40 and an annular support plate 50.

(3) Structure of Blade of Cross-Flow Fan

Figure 3:
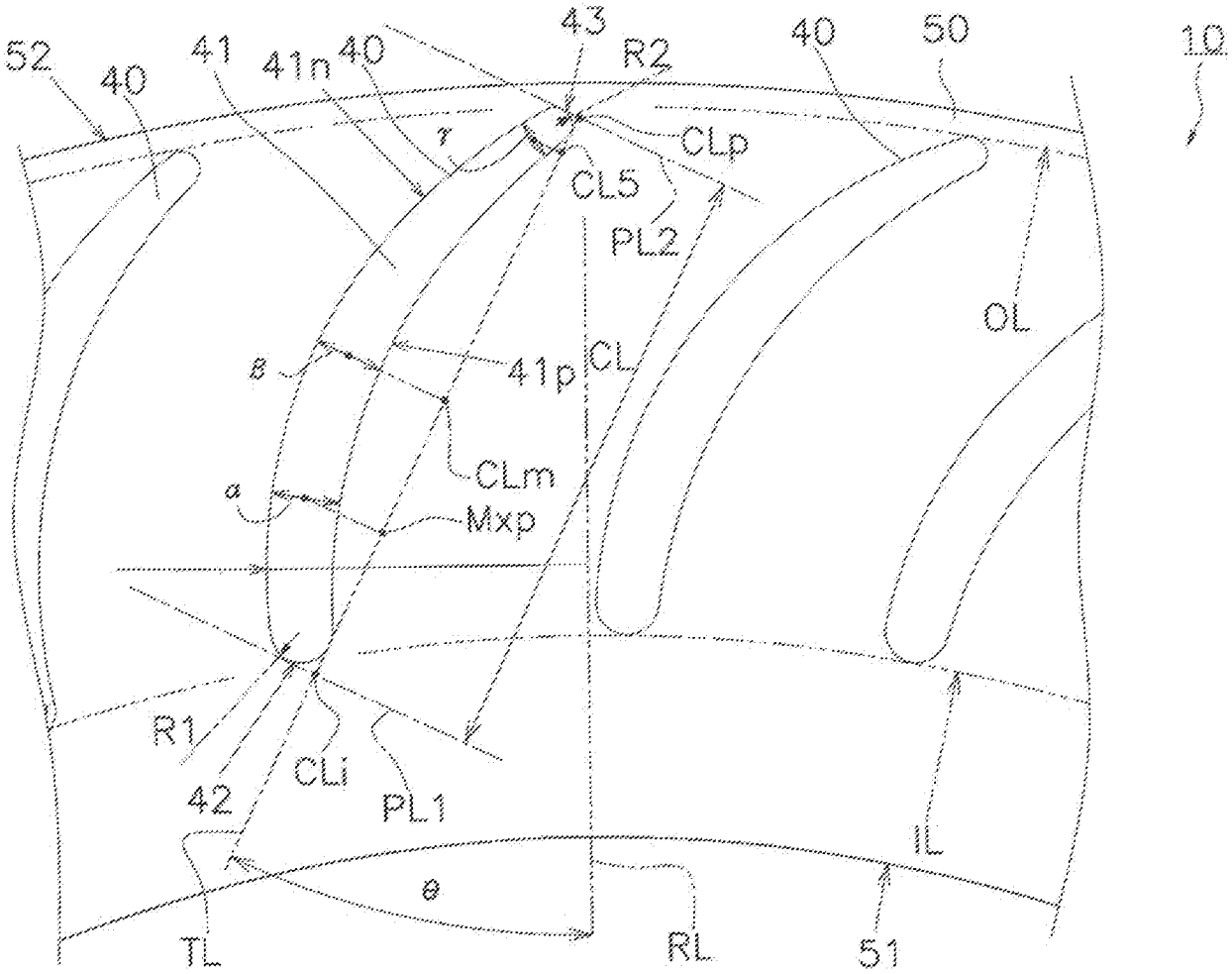
FIG. 3 is a partial expanded plan view for illustrating a cross-sectional shape of a blade according to the embodiment.

FIG. 3 shows a plurality of blades 40 secured to the support plate 50 of one of the fan blocks 30. The support plate 50 is annular in shape, and has an inner-peripheral end 51 on the inner-peripheral side of the cross-flow fan 10, and an outer-peripheral end 52 on the outer-peripheral side of the cross-flow fan 10. Each of the blades 40 is configured from a base portion 41, a leading-edge portion 42, and a trailing-edge portion 43. The following cross-sectional shape is employed in common in all of the blades 40 arranged on one of the fan blocks 30, as viewed in a cross-section taken along a plane parallel to the support plate 50. All of the blades 40 arranged on one of the fan blocks 30 are arranged tangent to one inscribed circle IL and one circumscribed circle OL, which are concentric with respect to the inner-peripheral end 51 and the outer-peripheral end 52.

The leading-edge portion 42 is formed so as to describe a smooth, convex, arc-like shape on the inner-peripheral side of the blade 40, the leading-edge portion 42 having a surface of arc-like cross-section. The trailing-edge portion 43 is formed so as to describe a smooth, convex, arc-like shape on the outer-peripheral side of the blade 40, the trailing-edge portion 43 having a surface of arc-like cross-section. The base portion 41 is formed between the leading-edge portion 42 and the trailing-edge portion 43, the base portion having a pressure surface 41*p* and a suction surface 41*n*. The pressure surface 41*p* of the base portion 41 generates positive pressure, and the suction surface 41*n* of the base portion 41 generates negative pressure.

Each of the blades 40 is inclined by an angle θ with respect to a radial line RL intersecting a central axis O of the cross-flow fan 10, the radial line RL extending radially outward from the central axis O. The angle of inclination θ of the blade 40 is defined as an angle formed by the radial line RL and a tangent line TL on the inner-peripheral side of the blade 40.

The pressure surface 41*p* and suction surface 41*n* of each of the blades 40 are curved so as to describe smooth arcs that expand toward the outer-peripheral side in cross-section. Because the blades 40 have an angle of inclination θ with respect to radial lines RL, both the center of curvature of the arc of the pressure surface 41*p* and the center of curvature of the arc of the suction surface 41*n* are positioned on the inner-peripheral-surface side.

A chord length CL is the length from a leading end of the leading-edge portion 42 to a trailing end of the trailing-edge portion 43. Specifically, the tangent line TL on the inner-peripheral side of the blade 40 is extended to the inner-peripheral side and outer-peripheral side of the cross-flow fan, a perpendicular line PL1 is drawn perpendicular to the tangent line TL on the inner-peripheral side of the blade 40 so as to be tangent to the leading-edge portion 42, and a perpendicular line PL2 is drawn perpendicular to the tangent line TL so as to be tangent to the trailing-edge portion 43. The length from the perpendicular line PL1 to the perpendicular line PL2 constitutes the chord length CL.

The blades 40 are configured such that the thickness of the base portion 41; i.e., the distance between the pressure surface 41*p* and the suction surface 41*n* varies gradually further from the inner-peripheral side toward the outer-peripheral side. Therefore, there is one location where the thickness of the base portion 41 is greatest. The position where the thickness of the base portion 41 is greatest is referred to below as the "position of maximum thickness." In the present description, the thickness of the base portion 41 is defined as the space between the pressure surface 41*p* and the suction surface 41*n* in a direction perpendicular to the pressure surface 41*p*. The position of maximum thickness is indicated at a position at the foot of a perpendicular line drawn from midpoint between the pressure surface 41*p* and the suction surface 41*n* to the tangent line TL defining the chord length CL.

The performance of the cross-flow fan 10 is strongly impacted by the cross-sectional shape of the blades 40. A cross-sectional shape of the blades 40 that is configured and arranged to elicit excellent performance from the cross-flow fan 10 is described below. Each of the blades 40 is formed such that the radius R1 of the arc of the leading-edge portion 42 is greater than the radius R2 of the arc of the trailing-edge portion 43. For example, the radius R1 of the arc of the leading-edge portion 42 and the radius R2 of the arc of the trailing-edge portion 43 may be set so as to satisfy the relationship R1/R2>1.5, and more preferably to satisfy the relationship R1/R2>1.75. The position Mxp of maximum thickness of a blade 40 is positioned closer to the leading-edge portion 42 than to the trailing-edge portion 43. Specifically, the position Mxp of maximum thickness is positioned closer to the leading-edge portion 42 than to the midpoint CLm along the chord length. The blades 40 have a cross-sectional shape such that the relationship $\beta/\alpha>\gamma/\beta$ is satisfied, where the maximum thickness is designated as the maximum thickness α, the thickness at the midpoint CLm along the chord length CL is designated as midpoint thickness β, and the thickness at an outer-peripheral-side position CL5 set apart from an outer-peripheral end CLp of the blade chord by 5% of the chord length CL is designated as an outer-peripheral-side thickness γ.

(4) Relationship Between Structure of Blade and Improvements in Efficiency

Figure 4:
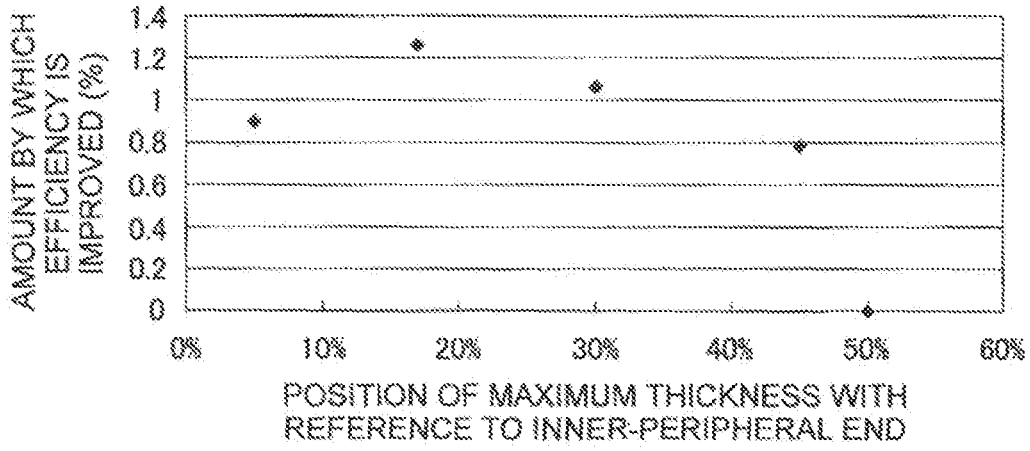
FIG. 4 is a graph for illustrating a relationship between a position of maximum thickness of the blade and an amount by which efficiency is improved.
Figure 6:
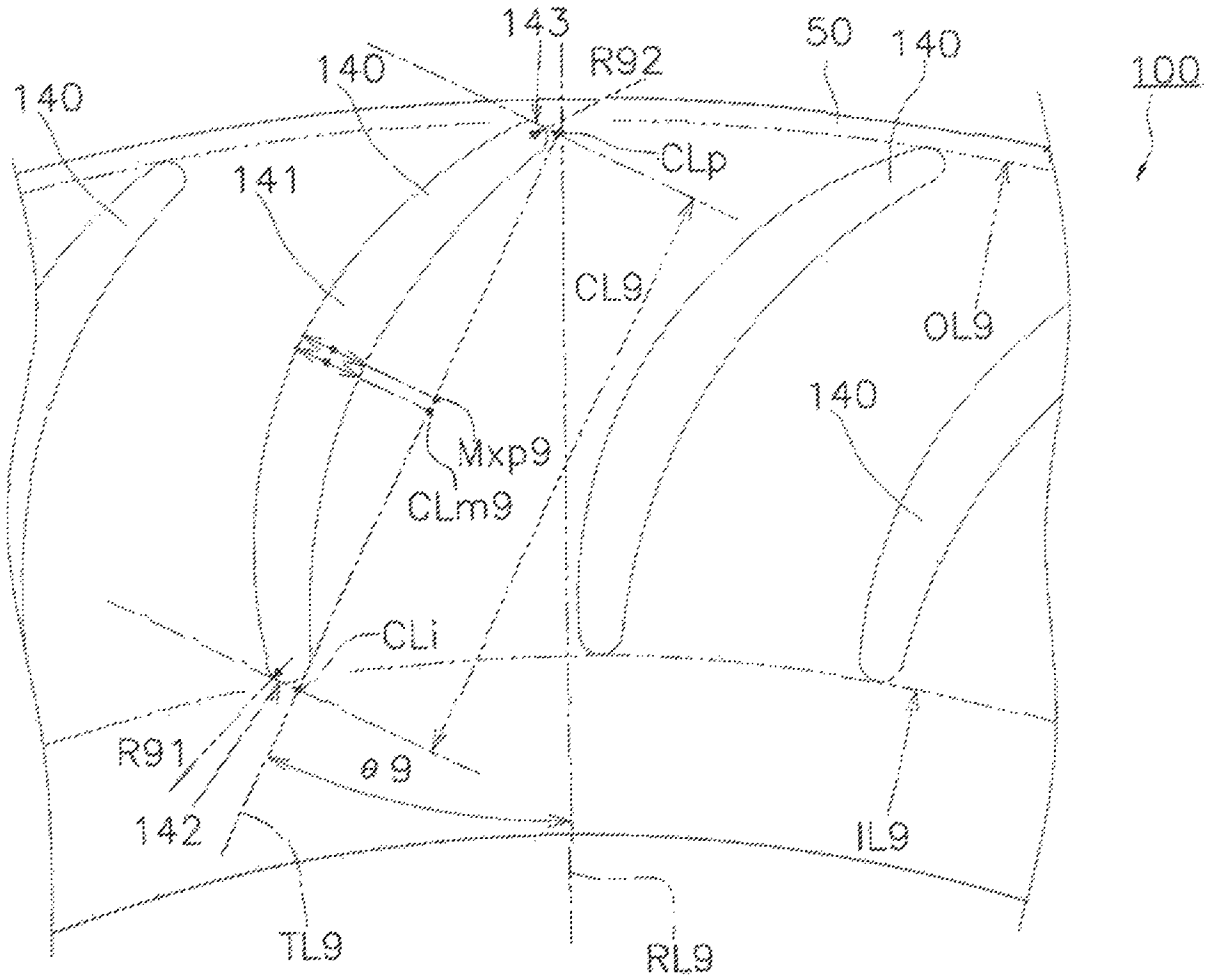
FIG. 6 is a partial expanded view for illustrating a cross-sectional shape of a conventional blade.

FIG. 4 shows the relationship between the position Mxp of maximum thickness and the amount by which efficiency is improved. The horizontal axis represents a ratio of the chord length CL and the position Mxp of maximum thickness with reference to an inner-peripheral end CLi of the blade chord. The vertical axis represents a rate of decrease from a shaft power of blades 140 having a conventional shape as shown in FIG. 6. Specifically, the rate of decrease is given by the formula (SPo−SPn)/SPo×100(%), where SPo indicates the shaft power required for a conventional cross-flow fan 100 using conventional blades 140 to obtain a prescribed airflow, and SPn indicates the shaft power required for the cross-flow fan 10 using the blades 40 to obtain the same airflow. In the blades 40 shown in FIG. 3, the value of $(\gamma/\beta)/(\beta/\alpha)$ is set to 0.64.

In the conventional cross-flow fan 100 shown in FIG. 6, the radius of an inscribed circle IL9 is approximately equal to the radius of the inscribed circle IL of the cross-flow fan 10, and the radius of a circumscribed circle OL9 is approximately equal to the radius of the circumscribed circle OL of the cross-flow fan 10. Additionally, a chord length CL9 of each of the blades 140 is approximately equal to the chord length CL of each of the blades 40, and the angle of inclination θ9 (an angle formed by a radial line RL9 and a tangent line TL9 on the inner-peripheral side of the blades 140) of the blades 140 is approximately equal to the angle of inclination θ of the blades 40. In the blades 140 shown in FIG. 6, the radius R91 of a leading-edge portion 142 and the radius R92 of a trailing-edge portion 143 are approximately the same, thereby constituting a point of difference from the blades 40 shown in FIG. 3. Additionally, a position Mxp9 of maximum thickness in each of the blades 140 is positioned in the vicinity of the midpoint position CLm9 along the chord length CL9, and is positioned further toward the outer-peripheral side than is the midpoint position CLm9. Due to being configured in such an arrangement, the blades 140 are formed in a crescent-form cross-sectional shape such that the thickness decreases in the same manner toward the inner-peripheral side and the outer-peripheral side.

As shown in FIG. 4, it is apparent that the distance from the inner-peripheral end CLi to the position Mxp of maximum thickness is preferably set within a range of 5-45% of the chord length CL. This is because, while an improvement in efficiency in an amount of 0.8-1.3% can be expected when the distance from the inner-peripheral end CLi to the position Mxp of maximum thickness is within a range of 5-45% of the chord length CL, the amount by which efficiency is improved rapidly declines in correspondence with distance from this range.

Figure 5:
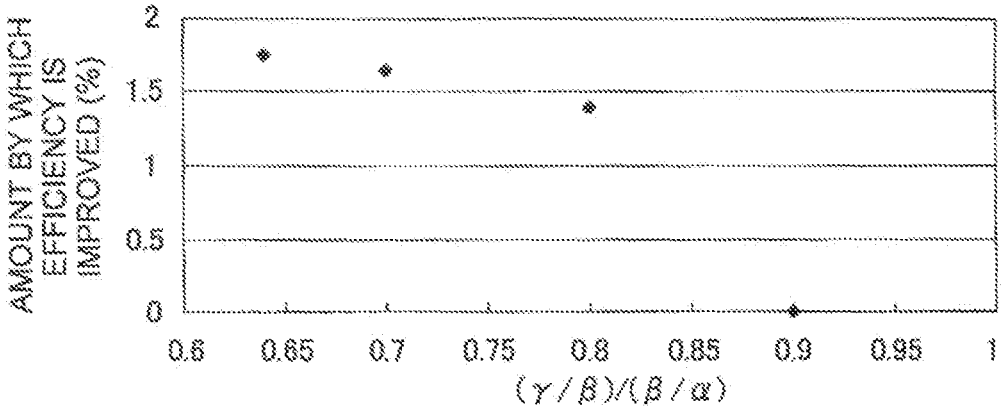
FIG. 5 is a graph for illustrating a relationship between the amount by which efficiency is improved and the ratio $(\gamma/\beta)/(\beta/\alpha)$.

FIG. 5 shows the relationship between the amount by which efficiency is improved and the ratio of (γ/β) and (β/α). The amount of improvement shown in FIG. 5 is the rate of decrease from the shaft power of blades for comparison, such as the blades disclosed in Patent Document 1, in which the position of maximum thickness is at a location 4% of a chord length from an inner-peripheral end, the radius of the leading-edge portion is approximately equal to the radius R1 of the leading-edge portion 42 of the blade 40, and the radius of the trailing-edge portion is approximately equal to the radius R2 of the trailing-edge portion 43 of the blade 40. In the blades for comparison, the cross-sections of the pressure surface and suction surface between the position of maximum thickness and the trailing-edge portion draw a single arc, and the blades have a cross-sectional shape such that the thickness decreases uniformly. In the blades 40 shown in FIG. 3, the position Mxp of maximum thickness is set to a location 17% from the inner-peripheral end.

As shall be apparent from FIG. 5, when (γ/β)/(β/α) is set to 0.85 or less, the amount by which efficiency is improved reaches a value greater than 1%. Thus, it is preferable for (γ/β)/(β/α) to 0.85 or less.

(5) Characteristics

As described above, the blades 40 of the cross-flow fan 10 are formed such that the radius R1 of the leading-edge portion 42 is greater than the radius R2 of the trailing-edge portion 43. Additionally, the base portion 41 of each of the blades 40 has a maximum thickness α at a position Mxp of maximum thickness that is closer to the leading-edge portion 42 than to the trailing-edge portion 43. Additionally, the blades 40 have a thickness 13 (an example of a first thickness) at the midpoint CLm along the blade chord, and a thickness γ (an example of a second thickness) at an outer-peripheral-side position CL5 set apart from the outer-peripheral end CLp of the blade chord by 5% of the chord length. The blades 40 are also formed such that the value obtained by dividing the thickness β located at the midpoint CLm along the blade chord by the maximum thickness α is greater than the value obtained by dividing the thickness γ located at the outer-peripheral-side position CL5 by the thickness β. Specifically, the cross-sectional shape of the blades 40 is formed so as to satisfy the relationship β/α>γ/β.

The base portion 41 of each of the blades 40 is formed such that the maximum thickness α is positioned within a range of 5-45% of the chord length CL from the inner-peripheral end. Specifically, the base portion 41 is formed so as to satisfy the relationship 5≤(distance from inner-peripheral end CLi to position Mxp of maximum thickness)/CL×100≤45. Additionally, the base portion 41 is configured such that the value of the ratio ((γ/β)/(β/α)) between the value obtained by dividing the thickness γ located at the outer-peripheral-side position CL5 by the thickness β located at the midpoint CLm along the blade chord and the value obtained by dividing the thickness β by the maximum thickness α is set to 0.85 or less.

Figure 8:
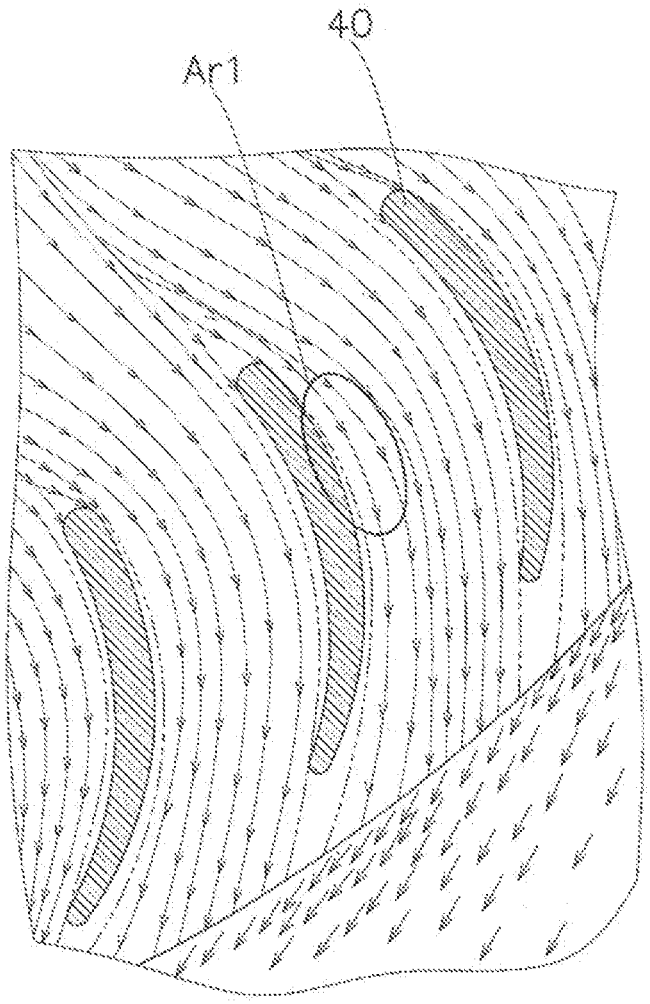
FIG. 8 is a schematic view for illustrating an airflow flowing around the blade according to the embodiment.
Figure 9:
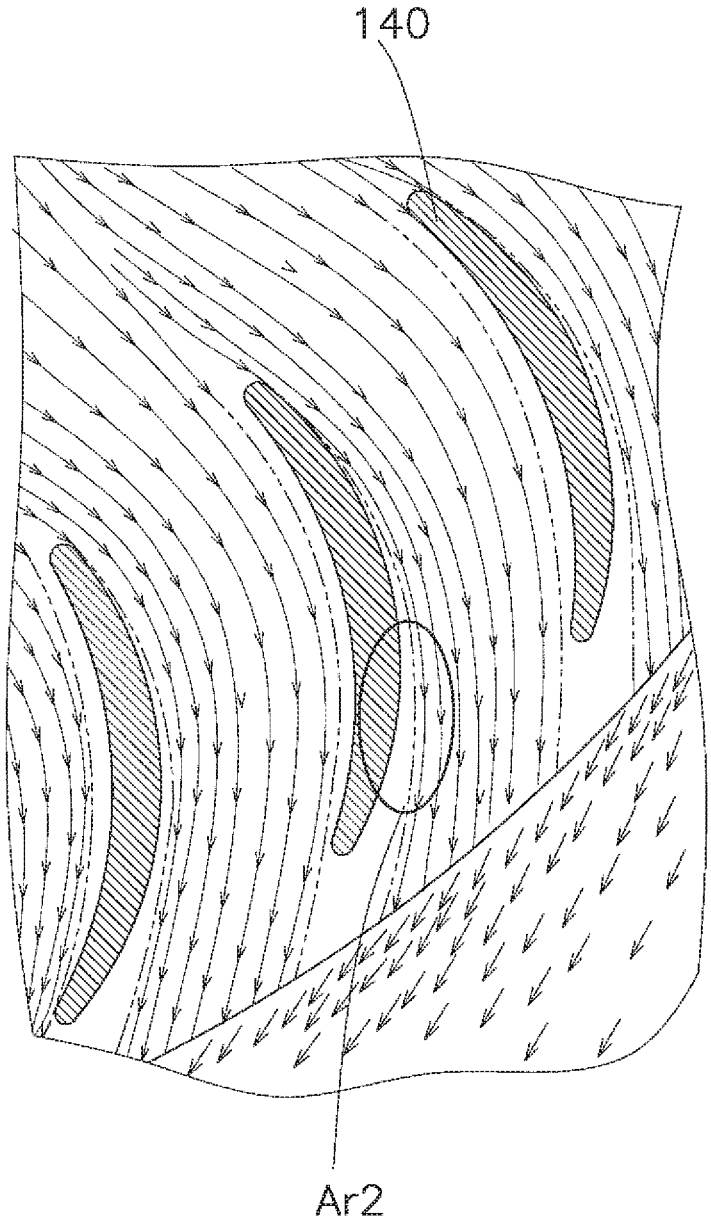
(PRIOR ART) FIG. 9
FIG. 9 is a schematic view for illustrating an airflow flowing around a conventional blade.
Figure 10:
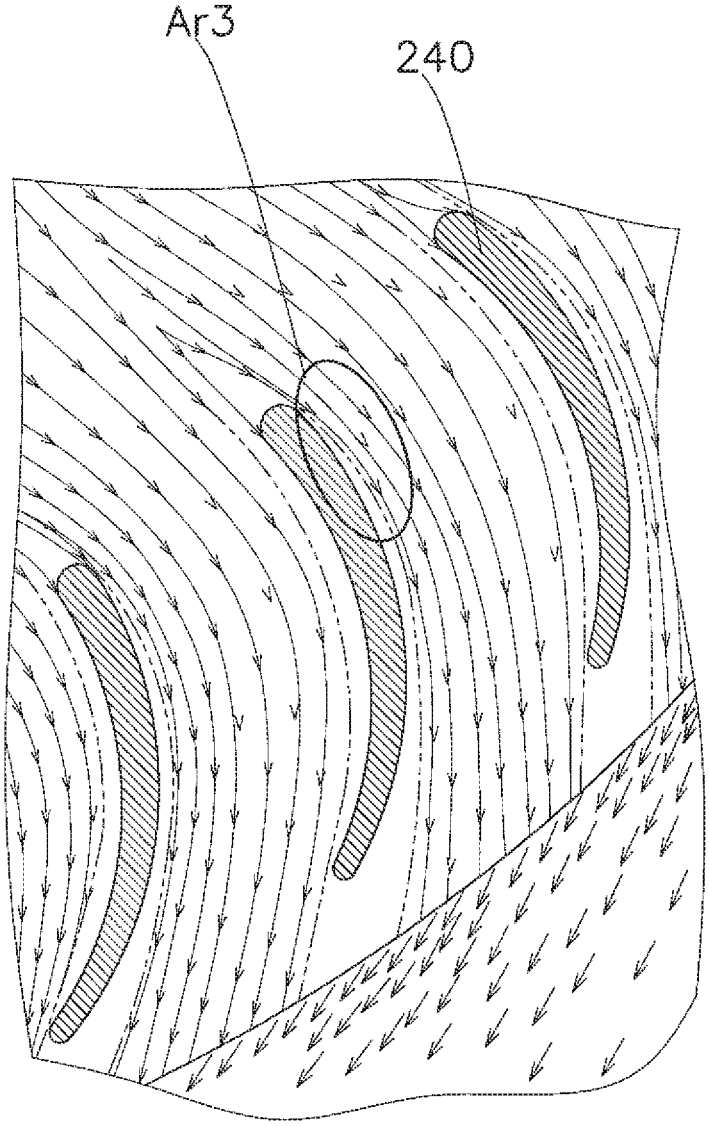
(PRIOR ART) FIG. 10
FIG. 10 is schematic view for illustrating an airflow flowing around a conventional blade.

FIG. 8 is a schematic view of an airflow flowing around a blade 40. FIG. 9 is a schematic view of an airflow flowing around a conventional blade 140 (see FIG. 6) with reference to the amount by which efficiency is improved in FIG. 4 described above. FIG. 10 is schematic view of an airflow flowing around a conventional blade 240 with reference to the amount by which efficiency is improved in FIG. 5 described above. In FIGS. 8, 9, and 10, the chain double-dash lines indicate blade-side portions where the airflow travels at a relatively slower speed.

As a result of the blades 40 having the shape described above, as pertains to the flow in the vicinity of the blades 40 when air is vented, the position Mxp of maximum thickness is located at a position closer to the leading-edge portion 42 than to the midpoint CLm along the blade chord; i.e., closer to the inner-peripheral side than to the middle of the blade, whereby separation of flow at the suction surface 41*n* (region Ar1 in FIG. 8) from the leading-edge portion 42 of the blade 40 to the trailing-edge portion 43 of the blade 40 is minimized. Furthermore, since the blade surface at the suction surface has a small curvature because the thickness is smoothly reduced as far as a location near the middle of the blade, it is possible, even if separation of suction surface-side flow occurs, to quickly rejoin the flow at the suction surface and minimize separation to the middle of the blade. However, in the conventional blade 140 shown in FIG. 9, because the thickness rapidly decreases from the portion of maximum thickness in the blade 140, separation readily occurs at a region Ar2. In the conventional blade 240 shown in FIG. 10, because the portion of maximum thickness in the blade 240 is close to the leading-edge portion, and the thickness begins decreasing from the portion of maximum thickness, there is a high possibility that, after colliding with the leading-edge portion, the flow will quickly separate off at the region Ar3 due to the large curvature of the blade surface, and move downstream in the separated state without rejoining at the outer-peripheral side relative to a blade-midpoint position.

Figure 7:
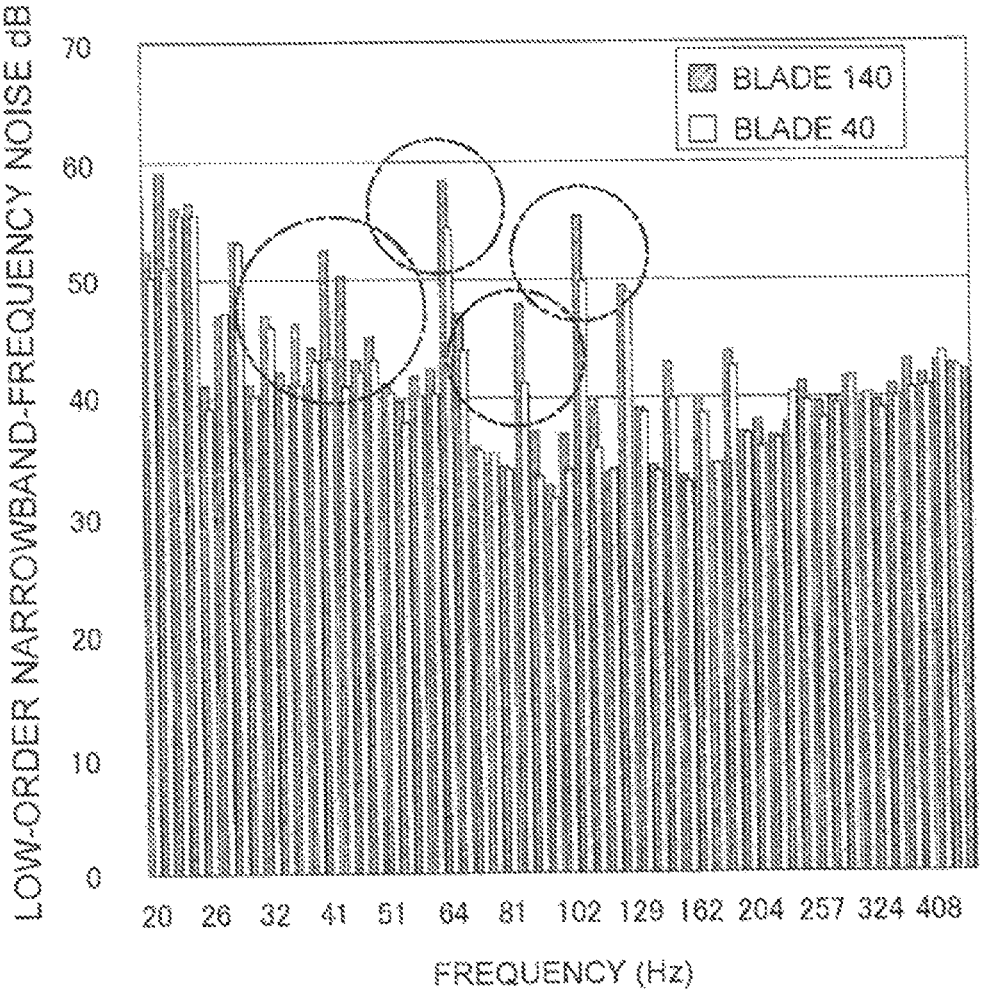
FIG. 7 is a graph for illustrating a decrease in effect of low-order narrowband-frequency noise.

In the blade 40 described above, the flow from the leading-edge portion 42 to the trailing-edge portion 43 is accelerated, turbulence is suppressed, and low-frequency narrowband noise such as N noise is reduced. Specifically, as shall be apparent from comparing the blades 40 shown in FIG. 3 with the blades 140 shown in FIG. 6, low-frequency narrowband N noise is reduced as shown in FIG. 7. In particular, in the portions surrounded by chain double-dash lines in FIG. 7, a pronounced effect for reducing N noise is realized by switching from the conventional blade 140 to the blade 40 according to the present embodiment.

The invention claimed is:

1. A blade of a cross-flow fan comprising:

a leading-edge portion arranged on an inner-peripheral side of the cross-flow fan, the leading-edge portion being formed in an arc shape;

a trailing-edge portion arranged on an outer-peripheral side of the cross-flow fan, the trailing-edge portion being formed in an arc shape; and a base portion formed between the leading-edge portion and the trailing-edge portion, the base portion having a pressure surface configured and arranged to generate positive pressure, and a suction surface configured and arranged to generate negative pressure, the leading-edge portion and the trailing-edge portion being formed such that a radius of the leading-edge portion is greater than a radius of the trailing-edge portion, and the base portion being configured such that a maximum thickness of the base portion is disposed at a position of maximum thickness that is closer to the leading-edge portion than to the trailing-edge portion so as to be disposed within a range of 5-45% of the chord length from an inner-peripheral end, a first thickness is disposed at the midpoint on a blade chord, a second thickness is disposed at a position set apart from an outer-peripheral end of the blade chord by 5% of the chord length, a value obtained by dividing the first thickness by the maximum thickness is greater than a value obtained by dividing the second thickness by the first thickness, and a ratio of the value obtained by dividing the second thickness by the first thickness with respect to the value obtained by dividing the first thickness by the maximum thickness is in a range of 0.64 to 0.80.

2. The blade of a cross-flow fan according to claim 1, wherein the base portion is configured such that the position of maximum thickness is positioned within a range of 5-30% of the chord length from an inner-peripheral end.

* * * * *